US006669053B1

(12) United States Patent
Garson et al.

(10) Patent No.: US 6,669,053 B1
(45) Date of Patent: Dec. 30, 2003

(54) BEVERAGE DISPENSER

(76) Inventors: Brent Garson, 36850 Pepper Dr., Solon, OH (US) 44139; Aviel Dafna, 1 Kol Dodi, Modiin (IL), 71007; Fabrizio Pin, Via Canova 19 - Villorba, Treviso (IT), 31050

( * ) Notice: Subject to any disclaimer, the term of this patent is extended or adjusted under 35 U.S.C. 154(b) by 0 days.

(21) Appl. No.: 10/407,753

(22) Filed: Apr. 5, 2003

(51) Int. Cl.[7] ..... B67D 5/08
(52) U.S. Cl. ..... 222/61; 222/129.1; 222/148
(58) Field of Search ..... 222/129.1, 61, 222/148, 146.6

(56) References Cited

U.S. PATENT DOCUMENTS 4,903,862 A * 2/1990 Shannon et al. ..... 222/61
5,012,955 A * 5/1991 Shannon ..... 222/61

OTHER PUBLICATIONS

Cornelius Millennium 6000 Installation Manual, Publication No. 620919546 Revision C—see p. 14.
Polyvend Model CSV–3 Service Manual—See p. 40
Coldtron 1 Parts Manual; Manual 3150060B—see p. 4–77.
Coldtron B–I–B Model 316 Parts Manual; Copyright 4–95; 3160060 Rev. C See pp. 82–84.
Rowe 406 Cold Drink Vendor Field Service Manual and Parts Catalog Twelfth Edition; Part No. 900–40650 L—see p. 6–42.
FPU1600 Series Peristaltic Metering Pumps Ideal for OEM Applications OMEGA Engineering; Copyright 2001.
FPU 100 Economical Peristaltic Pump; OMEGA Engineering Inc.; Copyright 2001.
FPU500 FPU5MT Peristaltic Pump; OMEGA Engineering; Copyright 2000.

* cited by examiner

*Primary Examiner*—Philippe Derakshani

(57) ABSTRACT

A beverage dispenser for blending a mix and a beverage concentrate to dispense a blended beverage formed from the mix and the concentrate includes a supply of mix, a supply of at least a single type of concentrate, a manifold, a first conduit connecting the supply of concentrate to the manifold, a first valve for controlling fluid flow through the first conduit, a vacuum source operatively connected to the manifold to establish a vacuum in the manifold to draw the concentrate from the supply of concentrate through the first conduit and into the manifold when the first valve is in its open position, a second conduit for directing the mix to the manifold and a dispensing station for dispensing a blended beverage formed from a predetermined amount of mix and predetermined amount of concentrate.

40 Claims, 3 Drawing Sheets

BEVERAGE DISPENSER

BACKGROUND OF THE INVENTION

RELATED APPLICATIONS

NONE

1. Field of the Invention

The present invention relates to a beverage dispenser for blending a plurality of beverage concentrates and a mix to form and dispense a blended fluid formed from mixing predetermined amounts of the concentrate and mix.

2. Description of the Related Art

Dispenser assemblies are known for mixing predetermined amounts of different types of fluids to form a blended beverage to be dispensed. In particular, it is known to mix a beverage concentrate such as a concentrated beverage syrup, with a mix, such as water or carbonated water, to form a blended beverage, such as soda, to be dispensed. Known beverage dispensers utilize a pump to supply the concentrate to a mixing chamber where the concentrate can be blended with a mix to form a blended beverage to be dispensed. When a plurality of beverage concentrates are available, a separate pumping apparatus is generally associated with each concentrate to enable selected concentrates to be individually pumped and dispensed and to prevent mixing of the concentrates.

When a beverage for human consumption is being blended, it is desirable to seal the beverage dispensing system to prevent foreign material and bacteria from entering the system. It is well known to utilize peristaltic pumps in beverage dispensing and blending systems due to the sealed configuration of the peristaltic pumps. In known beverage dispensers, a peristaltic pump is provided for each individual supply of concentrate so that various concentrates can be independently blended with a mix on demand. In typical beverage dispensing machines one to five individual supplies of a concentrated beverage are each provided with a peristaltic metering pump to pump, on demand, a predetermined amount of a preselected supply of beverage concentrate. Thus, if five supplies of beverage concentrate are provided to make five flavors of beverage, for example, grape, cherry, lemon, orange, and lime, five individual peristaltic metering pumps are required. The use of a plurality of pumps substantially increases the cost of the beverage dispensing mechanism.

From a commercial standpoint, it is desirable to minimize the cost of any beverage dispensing mechanism. It is also desirable to utilize a single pump to pump a selected beverage concentrate from multiple supplies of beverage concentrate while at the same time preventing unwanted mixing of the multiple supplies of beverage concentrate.

SUMMARY OF INVENTION

The present invention relates to a new and improved fluid dispenser assembly in which a beverage concentrate is blended with a mix such as water to make a mixed beverage wherein a vacuum is utilized to draw the beverage concentrate from a supply of beverage concentrate to mix the beverage concentrate with a mix such as water to form a mixed beverage to be dispensed.

The present invention relates to a new and improved beverage dispenser for mixing water and a beverage concentrate to dispense a mixed beverage formed from mixing a predetermined amount of beverage concentrate with a predetermined amount of water including a water supply, a supply of at least a single type of beverage concentrate, a manifold, a first conduit connecting the supply of beverage concentrate to the manifold, a first valve located in the first conduit having an open position in which the manifold is in fluid communication with the supply of beverage concentrate and a closed position in which the supply of beverage concentrate is isolated from the manifold, a pump having an inlet at which a negative pressure is established with the inlet of the pump being operatively connected to the manifold to establish a negative pressure in the manifold to draw the beverage concentrate from the supply of beverage concentrate into the manifold when the first valve is in its open position to provide a predetermined amount of beverage concentrate in the manifold, a second conduit for directing the water supply to the manifold to mix the beverage concentrate in the manifold with a predetermined amount of water to make a mixed beverage and a dispensing station at which the mixed beverage is dispensed.

The present invention further relates to a new and improved beverage dispenser for blending a mix and a concentrate to dispense a blended beverage formed from mixing a predetermined amount of concentrate with a predetermined amount of mix including a mix supply, a supply of at least a single type of concentrate, a manifold, a first conduit connecting said supply of concentrate to said manifold, a first valve for controlling fluid flow through said first conduit, a vacuum source operatively connected to the manifold to establish a negative pressure in the manifold to draw the concentrate from the supply of concentrate through the first conduit into the manifold, a second conduit for directing the mix to the manifold to blend the concentrate in the manifold with a predetermined amount of mix to make a blended beverage from a predetermined amount of mix and a predetermined amount of concentrate and a dispensing station for dispensing the blended beverage.

Still another provision of the present invention is to provide a new and improved beverage dispenser for blending a mix and a concentrate to dispense a blended beverage formed from blending a predetermined amount of concentrate with a predetermined amount of mix including a supply of mix, a plurality of supplies of concentrate, a manifold, a plurality of conduits each of which connects one of plurality of supplies of concentrate to the manifold, a plurality of valves one of which is disposed in each of the plurality of conduits and each of which has an open and a closed position to control the flow of concentrate through the associated conduit from a supply of concentrate, a vacuum source operatively connected to the manifold to establish a negative pressure in the manifold to draw the concentrate from one of supplies of concentrate through one of the plurality of conduits and one of the plurality of valves and into the manifold to provide a predetermined amount of concentrate in the manifold, a second conduit for directing the mix to the manifold to blend the concentrate in the manifold with a predetermined amount of mix to make a blended beverage and a dispensing station for dispensing the blended beverage.

BRIEF DESCRIPTION OF THE DRAWINGS

The foregoing and other features of the invention will become more apparent in consideration of the following description taken in connection with the accompanying drawings wherein.

DETAILED DESCRIPTION OF THE INVENTION

Figure 1:
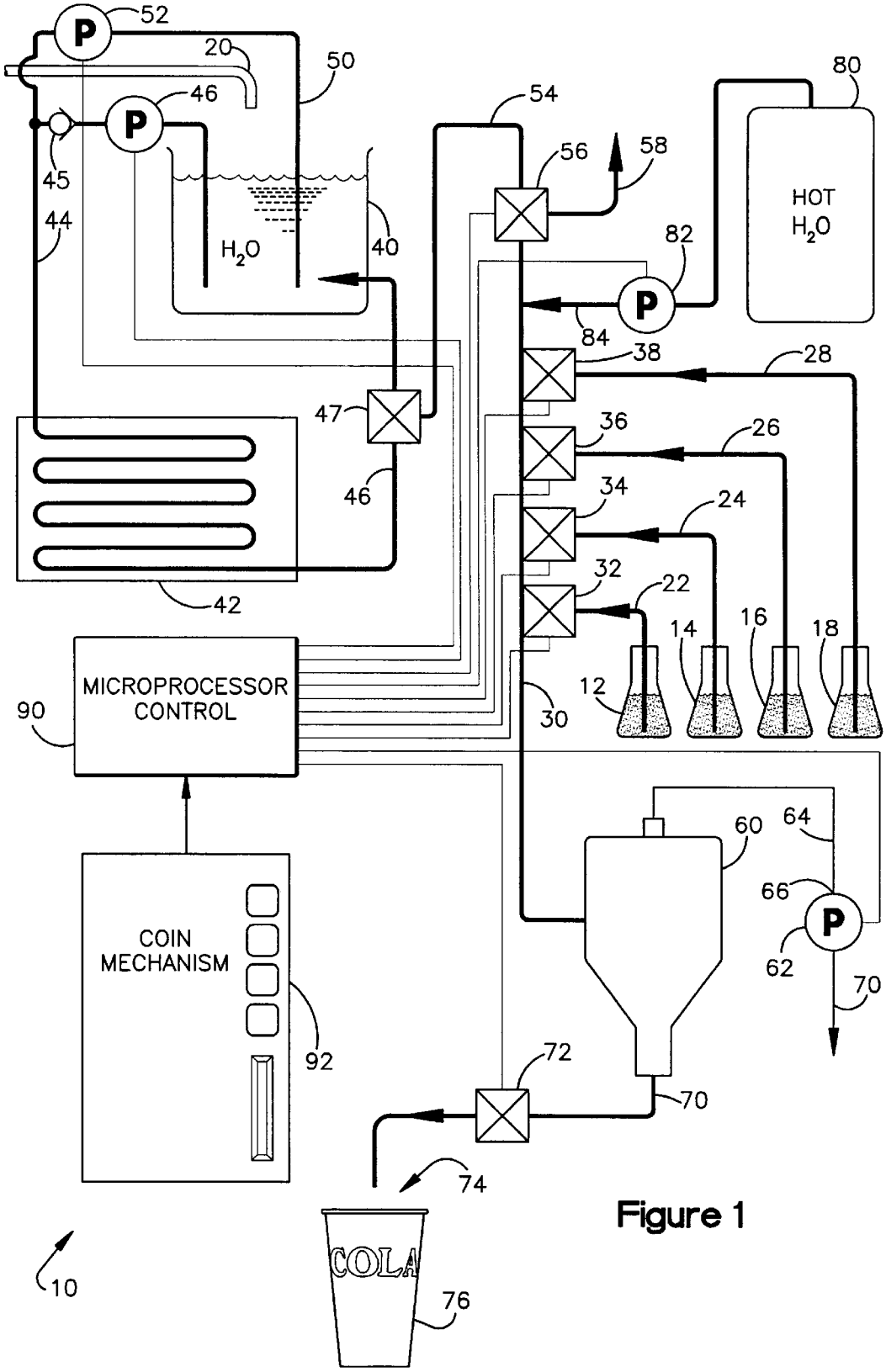
FIG. 1 is a schematic representation of a beverage dispenser constructed in accordance with the present invention.

Referring to the figures, a beverage dispenser 10 is disclosed for blending a mix and a beverage concentrate to form a blended beverage. The beverage dispenser 10 includes supplies 12, 14, 16, and 18 of beverage concentrate. Each supply of concentrate 12, 14, 16, and 18 comprises a unique supply of beverage concentrate which can be blended with a mix to form a beverage. A mix supply 20 is provided to supply a mix such as water or carbonated water to be blended with at least one of the beverage concentrates to form a blended beverage to be dispensed. In the illustrated embodiment, each supply 12, 14, 16, and 18 of beverage concentrate is a separate unique supply. Examples of concentrates which can be utilized in the present apparatus 10 include fruit juice and drink concentrates, soda concentrate and/or beverage syrup. While examples of concentrates and mixes have been provided, it should be apparent to one of ordinary skill that other mixes and concentrates could easily be substituted for those listed and are contemplated to be within the scope of the present invention.

A conduit connects each of the supplies 12, 14, 16, and 18 of beverage concentrate to a manifold 30. Conduit 22 is connected to manifold 30 to supply beverage concentrate 12, conduit 24 is connected to manifold 30 to supply beverage concentrate 14, conduit 26 is connected to manifold 30 to supply beverage concentrate 16 and a conduit 28 is connected to the manifold 30 to supply beverage concentrate 18. A valve is associated with each of the lines 22, 24, 26, and 28 to control fluid flow through its associated conduit. Accordingly valve 32 controls fluid flow through conduit 22 to manifold 30, valve 34 controls fluid flow through conduit 24 to manifold 30, valve 36 controls fluid flow through conduit 26 to manifold 30 and valve 38 control fluid flow through conduit 28 to manifold 30. Each of the valves 32, 34, 36, and 38 have an open position which allows for fluid communication from its associated supply of beverage concentrate to the manifold 30 and a closed position in which the supply of beverage concentrate is isolated and blocked from the manifold 30. Each of the valves 32, 34, 36, and 38 can be controlled to provide for the flow of a predetermined amount of beverage concentrate to the manifold 30.

Figure 3:
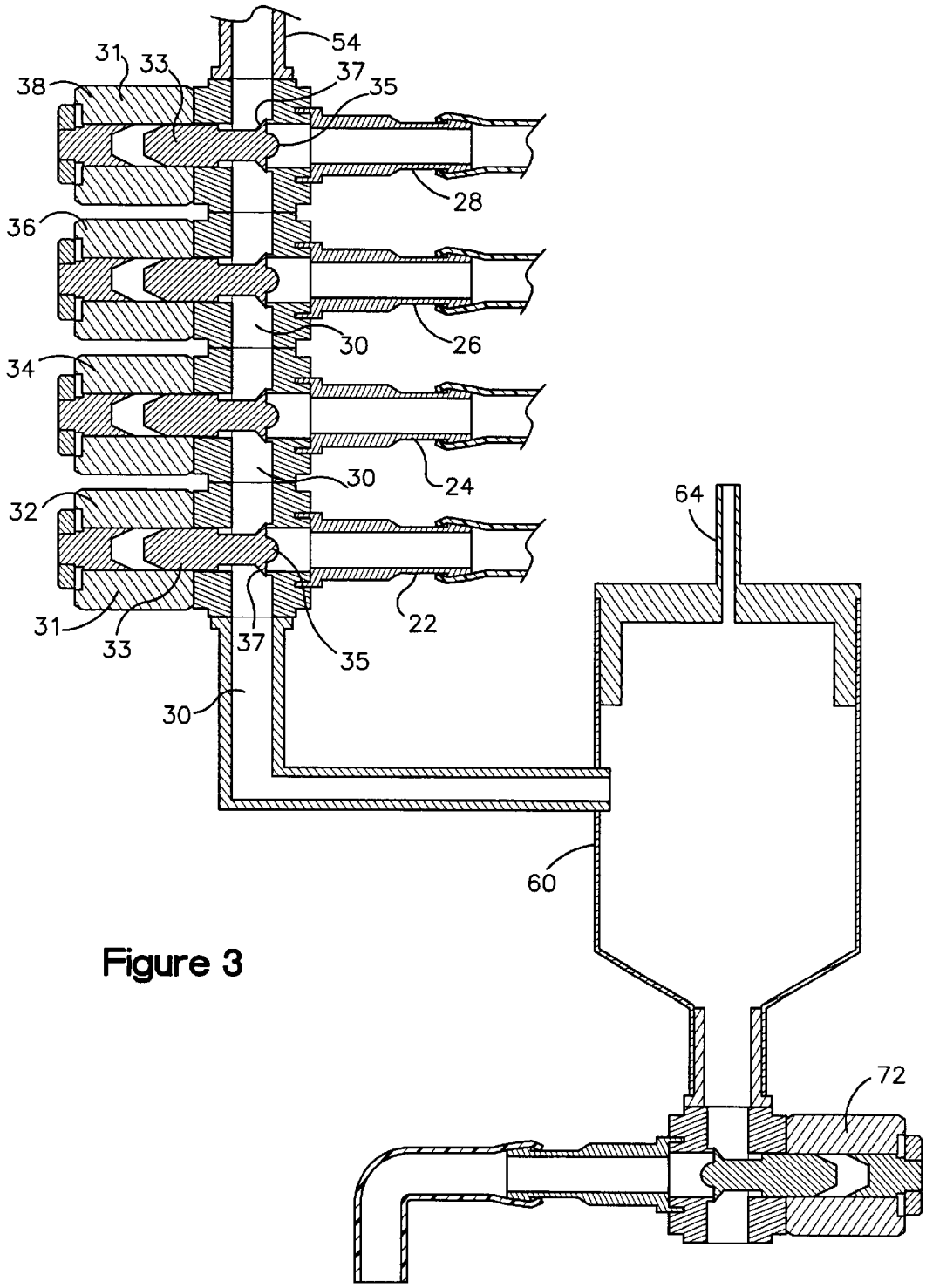
FIG. 3 is a cross sectional view more fully illustrating the valves and manifold.

FIG. 3 further illustrates the construction of the valves 32, 34, 36 and 38. Each of the valves is solenoid actuated and includes a coil 31, an armature 33 and a valve member 35 which is movable with armature 33 to engage or disengage with a valve seat 37. When the coil 31 is energized, armature 33 moves toward the left as is illustrated in FIG. 3 to move valve member 35 away from valve seat 37 to open the passageway associated therewith. When coil 31 is denergized the valve member 35 engages seat 37 to close the valve. As can be seen in FIG. 3, the valves 32, 34, 36, and 38 in part from a portion of manifold 30.

The mix supply 20 supplies a mix such as water to a water tank 40 which is connected to a cooler, such as a compressor/chiller schematically illustrated at 42, to cool the water supply disposed in the tank 40. A conduit 44 is disposed in the tank 40 and connected to a circulating pump 46 which pumps the water or other mix disposed in the tank 40 through a one way valve 45 through the conduit 44 and the cooler 42 which cools the mix and then returns the cooled water or mix through a conduit 46 and valve 47 to the interior of the mix storage tank 40. A mix pump 52 is connected to the mix storage tank 40 via a conduit 50. When the mix pump 52 is energized a supply of cooled mix is pumped from the tank 40 through conduit 50 and pump 52 to conduit 44 which is connected via a valve 47 to the conduit 54. When mix pump is energized valve 47 connects conduits 46 and 54 to direct mix from tank 40 to the manifold 30 through valves 47 and 56. Valve 56 has an open position in which conduit 54 is in fluid communication with the manifold 30 and a closed position in which conduit 54 is prevented from communicating with manifold 30. In addition valve 56 includes a bleed passageway 58 which opens to atmosphere when valve 56 is in its open position to enable the flow of fluid from manifold 30. Valve 56 is similar in construction to valves 32.

The manifold 30 interconnects valves 32, 34, 36, 38, and 56 and includes a mixing chamber 60 located at one end thereof. As an example the valves may be those, manufactured by Componenti Vending S. R. L. of Milano, Italy as Valve 522A2024DRSNV. A source of vacuum which in the illustrated embodiment is a vacuum pump 62 is connected via conduit 64 to the manifold 30. The drink or mix pump 62 may be a pump such as manufactured by KNF ITALIA S. R. L. of Milano, Italy having an inlet 66 and an outlet 70 with the inlet 66 being connected to conduit 64 to establish a vacuum in the manifold 30 when pump 62 is energized. As is illustrated in FIGS. 1 and 2, the conduit 64 is connected to the top portion of the mixing chamber 60 disposed in manifold 30 above any fluid disposed in mixing chamber 60 to ensure that conduit 64 and pump 62 do not draw any fluid in mixing chamber 60 into conduit 64.

When it is desired to mix a predetermined amount of a selected beverage concentrate with the mix, the pump 62 is energized to establish a vacuum in manifold 30 and the valve 32, 34, 36, or 38 associated with the selected beverage concentrate 12, 14, 16 or 18 is energized to open the valve connected to the selected beverage concentrate. Valve 56 is closed at this time to prevent mix from flowing into manifold 30 and to maintain a vacuum in manifold 30. When pump 62 is energized and one of the valves 32, 34, 36, or 38 is open beverage concentrate will be drawn by the vacuum created by pump 62 from the selected supply of beverage concentrate into the manifold 30. When a predetermined amount of beverage concentrate is disposed in the manifold 30, the valve associated with the beverage concentrate supply is closed and pump 62 is deenergized. The beverage concentrate in manifold 30 preferably flows under the influence of gravity into the mixing chamber 60 which is located at the bottom of manifold 30. Controlling the amount of time that the valve 32, 34, 36, or 38 is opens controls the amount of beverage concentrate that is drawn into the manifold 30 by the vacuum established by pump 62.

Figure 2:
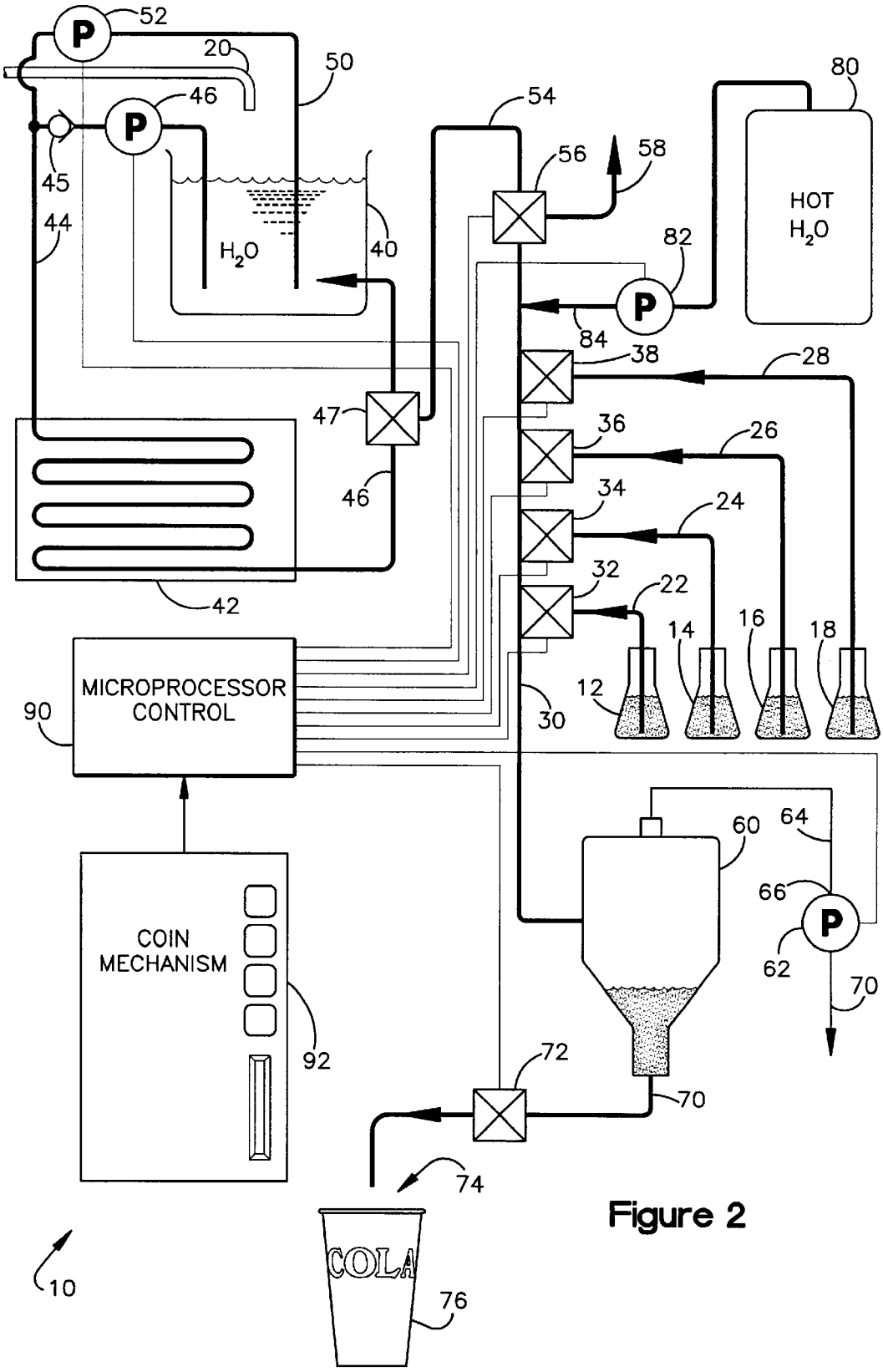
FIG. 2 is a schematic representation of a beverage dispenser constructed in accordance with the present invention illustrating a predetermined amount of beverage concentrate located in the manifold prior to being mixed in the manifold with a mix.

After a predetermined amount of beverage concentrate is drawn into the manifold 30 as is illustrated in FIG. 2, pump 62 is deenergized and the valve associated with the supply of beverage concentrate is closed. Valve 56 is then opened and drink pump 52 energized to supply through valve 56 a supply of mix to manifold 30 at high pressure. The mix is directed through valve 56 and into the manifold 30 where it is blended with the beverage concentrate disposed in manifold 30 to form a blended beverage to be dispensed. The mix pump 52 typically supplies the mix at 2.13 psi to manifold 30 to cause through blending of the mix and beverage concentrate. Additionally, mixing chamber 60 can be conically shaped to further mix the beverage concentrate and mix. Opening valve 56 connects the upper portion of the manifold 30 to atmosphere via the passageway 58 to prevent fluid lock in the manifold 30 and to allow the beverage concentrate and mix to flow in a downwardly direction under the influence of gravity through manifold 30 and through the mixing chamber 60 disposed therein. The supply of high pressure mix at the top of manifold 30 washes any beverage concentrate in manifold 30 into mixing chamber 60 where it is blended and disposed. The supply of the mix after the supply of concentrate cleans the manifold 30 of the concentrate so that the next drink to be blended is not contaminated by the previous beverage concentrate. Thus, a single pump 62 is provided to draw a preselected beverage concentrate from a plurality of supplies of beverage concentrate 12, 14, 16 and 18 without mixing the beverage concentrate.

A conduit 70 is connected to the bottom of the mixing chamber 60 located in the manifold 30 and connects the bottom of the mixing chamber 60 to a dispensing station 74. A valve 72 is located in conduit 70 to control the flow of fluid therethrough to the dispensing station 74. The valve 72 has an open position in which fluid flow is permitted through conduit 70 to the dispensing station 74 and a closed position in which fluid flow is prevented. As is illustrated in FIG. 3, valve 72 may be similar to valve 32. A cup 76 or other type of container can be located at the dispensing station 74 to receive the blended beverage from manifold 30.

A hot water supply 80 may be connected via line 84 to the manifold 30. A pump 82 is provided for pressurizing the hot water flowing from the hot water supply 80 through the conduit 84 to the manifold 30. The hot water supply 80 can be periodically energized to clean valves 32, 34, 36, and 38 and to purge and clean manifold 30 and the dispensing valve, 72. The purging function may be operated manually wherein a cup or two of hot water is run through the manifold 30 and valves 32, 34, 36, 38 and 72 to cleanse same or can be done automatically after a predetermined number of blended beverages are dispensed. If an automatic mode is utilized, a drain may be required from the dispensing station to either a holding tank or drain lines to discharge the hot cleaning water.

A microprocessor control 90 is schematically illustrated to controlling operation of the beverage dispenser 10. The microprocessor control 90 is connected to each of the valves 32, 34, 36, 38, 56, and 72, and to the pumps 46, 52, 62, and 82 to control operation thereof. When it is desired to dispense a blended beverage, the microprocessor control 90 energizes pump 62 to establish a vacuum in manifold 30 and opens one of the valves 32, 34, 36, or 38 to enable the vacuum in manifold 30 to draw a predetermined amount of a preselected beverage concentrate into the manifold 30. The beverage concentrate flows through manifold 30 and into the mixing chamber 60 to locate a predetermined amount of beverage concentrate in mixing chamber 60 as is disclosed in FIG. 2. After a predetermined amount of concentrate is located in the mixing chamber 60, pump 62 is deenergized by the microprocessor control 90 and the valve 32, 34, 36, or 38 associated with the selected supply of the beverage concentrate is closed. Mix pump 52 is subsequently energized by the microprocessor control 90 and valve 56 is opened to provide for the flow of a high pressure mix such as water into the manifold 30 where it is mixed in the mixing chamber 60 with the beverage concentrate located therein. Valve 72 is then opened by the microprocessor control 90 and the blended beverage flows from manifold 30 and mixing chamber 60 through conduit 70 and open valve 72 to a dispensing station 74 where it is dispensed to a container such as a cup 76.

The beverage dispenser 10 may be manually actuated via a control panel (not illustrated) which is illustrated connected to microprocessor 90 or may be actuated via a coin or credit mechanism and control panel 92 which is connected to microprocessor control 90. If a control panel is utilized without a coin or crediting mechanism, a user pushes a button or otherwise actuates a control in a well known manner to select a predetermined beverage to be blended. If a coin or credit mechanism 92 is utilized, the user is required to enter a predetermined amount of coins or credit into the coin or credit mechanism 92 prior to the mechanism providing for actuation of the microprocessor control 90 and selection of a predetermined beverage to be blended.

It should be appreciated while a single beverage concentrate has been disclosed as being blended with the mix to form a blended beverage, in some situations it may be desirable to blend more than one type of beverage concentrate. This can be accomplished by either sequentially opening and closing some of the valves 32, 34, 36, or 38 or by simultaneously opening more than one valve. For example, if a lemon beverage concentrate is provided at one supply and a lime concentrate at another supply beverage dispenser 10 could blend a lemon beverage, a lime beverage or a lemon-lime beverage by drawing both lemon and lime beverage concentrate into mixing chamber 60.

While a cooler 42 has been disclosed to provide a source of cooled mix such as chilled water, it is possible to supplement or replace the cooler 42 with a heater to provide a supply of hot mix via conduit 54. Additionally, the water or mix supply 20 could be directly connected to conduit 50 without be cooled by cooler 42.

From the foregoing, it should be apparent that a new and improved fluid dispenser 10 has been disclosed for blending a mix and a beverage concentrate to dispense a blended fluid at the dispensing station 74 formed from mixing a predetermined amount of a concentrate with a predetermined amount of a mix. The fluid dispenser 10 includes a mix supply which in the illustrated embodiment is a water supply 20, a supply of at least a single type of concentrate 12, 14, 16, and 18, a manifold 30, and a first conduit 22, 24, 26, or 28 connecting the supply of an associated concentrate 12, 14, 16, or 18 to the manifold 30. A first valve 32, 34, 36, or 38 is provided for controlling fluid flow through the first associated conduit 22, 24, 26, or 28, respectively, and has an open position in which the manifold 30 is in fluid communication with the associated supply of concentrate and a closed position in which the supply of concentrate is isolated from the manifold 30. A vacuum source, in the form of a vacuum pump 62, is operatively connected to the manifold 30 via the conduit 64 to establish a negative pressure or vacuum in the manifold 30 to draw the beverage concentrate from the supply of concentrate through one of the first conduits 22, 24, 26, or 28 into the manifold 30 when one of the first valves 22, 24, 26, or 28 is in its open position to provide a predetermined amount of concentrate in the manifold 30. A second conduit 54 is provided for directing the mix to the manifold 30 to blend the beverage concentrate in the manifold 30 with a predetermined amount of mix to make a blended beverage formed from a predetermined amount of mix and a predetermined amount of concentrate. A dispensing station 74 is provided for dispensing the blended fluid into a container such as cup 76.

What we claim is:

1. A beverage dispenser for mixing water and a beverage concentrate to dispense a mixed beverage formed from mixing a predetermined amount of beverage concentrate with a predetermined amount of water comprising a water supply, a supply of at least a single type of beverage concentrate, a manifold, a first conduit connecting said supply of beverage concentrate to said manifold, a first valve in said first conduit having an open position in which said manifold is in fluid communication with said supply of beverage concentrate and a closed position in which said supply of beverage concentrate is isolated from said manifold, a pump having an inlet at which a negative pressure is established and an outlet, said inlet of said pump being operatively connected to said manifold to establish a negative pressure in said manifold when said pump is energized to draw said beverage concentrate from said supply of beverage concentrate through said first conduit and into said manifold when said first valve is in said open position to provide a predetermined amount of beverage concentrate in said manifold, a second conduit for directing said water supply to said manifold to mix the beverage concentrate in said manifold with a predetermined amount of water to make a mixed beverage from a predetermined amount of water and a predetermined amount of beverage concentrate and a dispensing station at which said mixed beverage may be dispensed.

2. A beverage dispenser for mixing water and a beverage concentrate to dispense a mixed beverage as set forth in claim 1, further including a third conduit providing for fluid communication between said manifold and said dispensing station and a dispensing valve having a closed position and an open position disposed in said third conduit for controlling the flow of mixed beverage between said manifold and said dispensing station.

3. A beverage dispenser for mixing water and a beverage concentrate to dispense a mixed beverage as set forth in claim 1, further including a second valve for controlling the fluid flow through said second conduit and having an open position in which said manifold is in fluid communication with said water supply and a closed position in which said water supply is isolated from said manifold.

4. A beverage dispenser for mixing water and a beverage concentrate to dispense a mixed beverage as set forth in claim 3, wherein said second valve further includes a passageway for operatively connecting said manifold to atmospheric pressure when said second valve is in said open position.

5. A beverage dispenser for mixing water and a beverage concentrate to dispense a mixed beverage as set forth in claim 3, further including a water pump for pressurizing the flow of water through said second conduit from said water supply to said manifold.

6. A beverage dispenser for mixing water and a beverage concentrate to dispense a mixed beverage as set forth in claim 1, wherein said manifold includes a mixing chamber in which said beverage concentrate and said water are mixed before said mixed beverage is directed to said dispensing station.

7. A beverage dispenser for mixing water and a beverage concentrate to dispense a mixed beverage as set forth in claim 6, wherein said inlet to said pump is located in said mixing chamber above said beverage concentrate to prevent said pump from drawing said beverage concentrate into said inlet of said pump.

8. A beverage dispenser for mixing water and a beverage concentrate to dispense a mixed beverage as set forth in claim 5, further including a microprocessor control for controlling said first, second and dispensing valves and said pump and said water pump, said microprocessor control being operative to energize said pump to establish a negative pressure in said manifold, open said first valve to enable said beverage concentrate to be drawn through said first conduit to said manifold, close said first valve and deenergize said pump when a predetermined amount of said beverage concentrate is in said manifold, energize said water pump and open said second valve to direct high pressure water through said second conduit and into said manifold to mix the beverage concentrate and said high pressure water to form a mixed beverage and to open said dispensing valve to control the flow of said mixed beverage from said manifold through said third conduit and to said dispensing station.

9. A beverage dispenser for mixing water and a beverage concentrate to dispense a mixed beverage as set forth in claim 1, wherein said water supply is a water supply for supplying cold water.

10. A beverage dispenser for mixing water and a beverage concentrate to dispense a mixed beverage as set forth in claim 9, further including a cooler for cooling said water supply.

11. A beverage dispenser for mixing water and a beverage concentrate to dispense a mixed beverage as set forth in claim 1, wherein said water supply is a supply of hot water.

12. A beverage dispenser for mixing water and a beverage concentrate to dispense a mixed beverage as set forth in claim 1, further including a pump for supplying water from said water supply to said manifold.

13. A beverage dispenser for mixing water and a beverage concentrate to dispense a mixed beverage as set forth in claim 1, further including a hot water supply for cleansing said beverage dispenser, said hot water supply being periodically connected to flow hot water through said first valve to cleanse said first valve.

14. A beverage dispenser for mixing water and a beverage concentrate to dispense a mixed beverage as set forth in claim 8, further including a hot water supply for cleansing said beverage dispenser, said hot water supply being periodically connected to flow hot water through said first valve to cleanse said first valve.

15. A beverage dispenser for blending a mix and a concentrate to dispense a blended beverage formed from mixing a predetermined amount of the concentrate with a predetermined amount of the mix comprising a mix supply, a supply of at least a single type of concentrate, a manifold, a first conduit connecting said supply of concentrate to said manifold, a first valve for controlling fluid flow through said first conduit having an open position in which said manifold is in fluid communication with said supply of concentrate and a closed position in which said supply of concentrate is isolated from said manifold, a vacuum source operatively connected to said manifold to establish a negative pressure in said manifold to draw said concentrate from said supply of concentrate through said first conduit and into said manifold when said first valve is in said open position to provide a predetermined amount of concentrate in said manifold, a second conduit for directing said mix to said manifold to blend the concentrate in said manifold with a predetermined amount of mix to make a blended beverage formed from a predetermined amount of mix and a predetermined amount of concentrate and a dispensing station for dispensing said blended beverage.

16. A beverage dispenser for blending a mix and a concentrate to dispense a blended beverage as set forth in claim 15, wherein said vacuum source is a pump having an inlet at which a negative pressure is established and an outlet, said inlet of said pump being operatively connected to said manifold to establish a negative pressure in said manifold when said pump is energized.

17. A beverage dispenser for blending a mix and a concentrate to dispense a blended beverage as set forth in claim 15, further including a third conduit connecting said dispensing station and said manifold and a dispensing valve disposed in said third conduit between said dispensing station and said manifold and having an open position in which said dispensing station is in fluid communication with said manifold and a closed position for controlling the flow of blended beverage through said third conduit to said dispensing station.

18. A beverage dispenser for blending a mix and a concentrate to dispense a blended beverage as set forth in claim 15, further including a second valve for controlling the fluid flow through said second conduit and having an open position in which said manifold is in fluid communication with said mix and a closed position in which said mix is isolated from said manifold.

19. A beverage dispenser for blending a mix and a concentrate to dispense a blended beverage as set forth in claim 18, wherein said second valve further includes a passageway for operatively connecting said manifold to atmospheric pressure when said second valve is in said open position.

20. A beverage dispenser for blending a mix and a concentrate to dispense a blended beverage as set forth in claim 16, further including a mix fluid pump for pressurizing the flow of mix through said second conduit to said manifold.

21. A beverage dispenser for blending a mix and a concentrate to dispense a blended beverage as set forth in claim 15, wherein said manifold includes a mixing chamber in which said mix and said concentrate are blended before said blended beverage is directed to said dispensing station.

22. A beverage dispenser for blending a mix and a concentrate to dispense a blended beverage as set forth in claim 16, wherein said manifold includes a mixing chamber in which said mix and said concentrate are blended before said blended beverage is directed to said dispensing station.

23. A beverage dispenser for blending a mix and a concentrate to dispense a blended beverage as set forth in claim 22, wherein the inlet to said pump is located in said mixing chamber above said concentrate to prevent said pump from drawing said concentrate into said inlet of said pump.

24. A beverage dispenser for blending a mix and a concentrate to dispense a blended beverage as set forth in claim 20, further including a microprocessor control for controlling said first, second and dispensing valves, said pump and said mix pump, said microprocessor control being operative to energize said pump to establish a negative pressure in said manifold, open said first valve to enable said concentrate to be drawn through said first conduit to said manifold, close said first valve and deenergize said pump when a predetermined amount of said concentrate is in said manifold, energize said mix pump and open said second valve to direct pressurized mix through said second conduit and into said manifold to mix the concentrate and said pressurized mix to form a blended beverage and to open said dispensing valve to control the flow of said blended-beverage from said manifold through said third conduit to said dispensing station.

25. A beverage dispenser for blending a mix and a concentrate to dispense a blended beverage as set forth in claim 15, further including a hot water supply for cleansing said fluid dispenser, said hot water supply being periodically connected to flow hot water through said first valve to cleanse said first valve.

26. A beverage dispenser for blending a mix and a concentrate to dispense a blended beverage formed from blending a predetermined amount of concentrate with a predetermined amount of mix comprising a supply of mix, a plurality of supplies of concentrate, a manifold, a plurality of conduits each of which connects one of said plurality of supplies of concentrate to said manifold, a plurality of first valves one of which is disposed in each of said plurality of conduits to control the flow of concentrate through said associated conduit to said manifold from an associated supply of concentrate, each of said first valves having an open position in which said manifold is in fluid communication with said valves associated supply of concentrate and a closed position in which said valves associated supply of concentrate is isolated from said manifold, a vacuum source operatively connected to said manifold to establish a negative pressure in said manifold to draw said concentrate from one of said supplies of concentrate through one of said plurality of conduits and into said manifold when one of said plurality of first valves is in said open position to provide a predetermined amount of a predetermined concentrate in said manifold, a second conduit for directing said mix said manifold to blend the concentrate in said manifold with a predetermined amount of mix to make a blended beverage formed from a predetermined amount of mix and a predetermined amount of concentrate and a dispensing station for dispensing said blended beverage.

27. A beverage dispenser for blending a mix and a concentrate to dispense a blended beverage as set forth in claim 26, wherein said vacuum source is a pump having an inlet at which negative pressure is established and an outlet, said inlet of said pump being operatively connected to said manifold to establish a negative pressure in said manifold when said pump is energized.

28. A beverage dispenser for blending a mix and a concentrate to dispense a blended mixed beverage as set forth in claim 26, further including a third conduit providing for fluid communication between said manifold and said dispensing station and a dispensing valve having a closed position and an open position disposed in said third conduit for controlling the flow of mixed beverage between said manifold and said dispensing station.

29. A beverage dispenser for blending a mix and a concentrate to dispense a blended beverage as set forth in claim 26, further including a second valve for controlling the fluid flow through said second conduit and having an open position in which said manifold is in fluid communication with said supply of mix and a closed position in which said supply of mix is isolated from said manifold.

30. A beverage dispenser for blending a mix and a concentrate to dispense a blended beverage as set forth in claim 29, wherein said second valve further includes a passageway for operatively connecting said manifold to atmospheric pressure when said second valve is in said open position.

31. A beverage dispenser for blending a mix and a concentrate to dispense a blended beverage as set forth in claim 29, further including a mix pump for pressurizing the flow of mix through said second conduit from said supply of mix to said manifold.

32. A beverage dispenser for blending a mix and a concentrate to dispense a blended beverage as set forth in claim 26, wherein said manifold includes a mixing chamber in which said concentrate and said mix are blended before said blended beverage is directed to said dispensing station.

33. A beverage dispenser for blending a mix and a concentrate to dispense a blended beverage as set forth in claim 32, wherein said inlet to said pump is located in said mixing chamber above said concentrate to prevent said pump from drawing said concentrate into said inlet of said pump.

34. A beverage dispenser for blending a mix and a concentrate to dispense a blended beverage as set forth in claim 29, further including a microprocessor control for controlling said first valves, said second valve and said pump, said microprocessor control being operative to energize said pump to establish a negative pressure in said manifold, open one said first valves to enable a selected beverage concentrate to be drawn through one said first conduits to said manifold, close said first valve and deenergize said pump when a predetermined amount of said beverage concentrate is in said manifold, and open said second valve to direct said supply of mix through said second conduit and into said manifold to blend the concentrate and said mix to form a blended beverage and to control the flow of said blended beverage from said manifold through said third conduit to said dispensing station.

35. A beverage dispenser for blending a mix and a concentrate to dispense a blended beverage as set forth in claim 26, wherein said supply of mix is a water supply for supplying cold water.

36. A beverage dispenser for blending a mix and a concentrate to dispense a blended beverage as set forth in claim 35, further including a cooler for cooling said water supply.

37. A beverage dispenser for blending a mix and a concentrate to dispense a blended beverage as set forth in claim 26, wherein said supply of mix is a water supply for supplying hot water.

38. A beverage dispenser for blending a mix and a concentrate to dispense a blended beverage as set forth in claim 26, further including a pump for supplying mix from said supply of mix to said manifold.

39. A beverage dispenser for blending a mix and a concentrate to dispense a beverage as set forth in claim 26, further including a hot water supply for cleansing said beverage dispenser, said hot water supply being periodically connected to flow hot water through said first valve to cleanse said first valve.

40. A beverage dispenser for blending a mix and a concentrate to dispense a beverage as set forth in claim 34, further including a hot water supply for cleansing said beverage dispenser, said hot water supply being periodically connected to flow hot water through said first valve to cleanse said first valve.

* * * * *